US005803809A

United States Patent [19]

Yoseloff

[11] Patent Number: 5,803,809

[45] Date of Patent: Sep. 8, 1998

[54] METHOD OF PLAYING A MULTI-DECKED POKER TYPE GAME

[75] Inventor: Mark L. Yoseloff, South Glastonbury, Conn.

[73] Assignee: Shuffle Master, Inc., Eden Prairie, Minn.

[21] Appl. No.: 715,597

[22] Filed: Sep. 18, 1996

[51] Int. Cl.[6] ..... A63F 1/00

[52] U.S. Cl. ..... 463/13; 273/292

[58] Field of Search ..... 273/292, 274, 273/309; 463/12, 13

[56] References Cited

U.S. PATENT DOCUMENTS

| | | | |
|---|---|---|---|
| 4,700,948 | 10/1987 | Okada | 273/143 R |
| 5,042,818 | 8/1991 | Weingardt | 273/292 |
| 5,100,137 | 3/1992 | Fulton | 463/13 |
| 5,167,413 | 12/1992 | Fulton | 463/13 |
| 5,251,897 | 10/1993 | Fulton | 463/13 |
| 5,255,915 | 10/1993 | Miller | 463/13 |
| 5,294,120 | 3/1994 | Schultz | 463/13 |
| 5,308,065 | 5/1994 | Bridgeman et al. | 463/13 |
| 5,356,140 | 10/1994 | Dabrowski et al. | 463/12 |
| 5,393,067 | 2/1995 | Paulsen et al. | 273/292 |
| 5,411,257 | 5/1995 | Fulton | 463/13 |

*Primary Examiner*—Benjamin H. Layno
*Attorney, Agent, or Firm*—Craig J. Lervick

[57] ABSTRACT

A method of playing a card game is provided where multiple separate decks of playing cards are utilized in a unique dealing scheme which results in unique and distinct winning hands not previously available. In the dealing scheme utilized by the method of the present invention, a hand is made up of a plurality of cards in a plurality of card positions. Each card position is dealt to from a predetermined deck of cards. By utilizing this dealing method, the possibility of unique hands containing "suited outcomes" is created. Because new and unique hands are created, wagering methods can easily be adapted to create a wagering game which is both exciting and easy to play. Furthermore, the game is easily adapted to a progressive jackpot type payout method, thus allowing the players the opportunity to win large amounts of money.

37 Claims, 7 Drawing Sheets

FIVE A
$$$$
SUITED-5-OF-A-KIND
$$$
ROYAL FLUSH
$$$
82
42
OUTCOME
REGULAR
EXACT MATCH
FIVE A
FIVE-OF-A-KIND
ROYAL FLUSH
STRAIGHT FLUSH
FOUR-OF-A-KIND
FULL HOUSE
FLUSH
STRAIGHT
THREE-OF-A-KIND
TWO PAIR
$$$$$
$$$$
$$$
$$$$
$$$
$$$
$$$$
$$$
$$
$$

METHOD OF PLAYING A MULTI-DECKED POKER TYPE GAME

BACKGROUND OF THE INVENTION

The present invention relates generally to a method of playing a poker type card game using multiple separate decks of playing cards. More specifically, the method of the present invention utilizes the multiple decks of playing cards to create new combinations of cards. Some of these combinations are used in wagering games as winning hands for which payouts can be made. Each of these new winning hands are allowed to coexist with existing well known poker hands.

Many different wagering games presently exist for use in both home and casino environments. Such games should necessarily be exciting, uncomplicated and easy to learn so as to avoid frustrating the players. Card games such as poker and Twenty-One have gained widespread popularity because of their established ranking of hands and well known rules. Furthermore, each of these games usually involve continuous wagering opportunities for the players thus increasing player participation and excitement. Lastly, the games move fairly quickly to maintain action and activity. All of these factors have created games which are widely accepted and widely known.

One method of increasing the excitement and attraction of wagering games is the inclusion of additional wagering opportunities and payout schemes. For example, in a progressive jackpot scheme certain outcomes are designated to pay out a progressive amount. In this progressive jackpot scheme, a portion of each wager is provided to the progressive jackpot thereby increasing the jackpot amount.

Another method of increasing excitement for the players is to provide additional winning hands or winning possibilities. This has previously been accomplished by such means as adding jokers or wild cards to poker games. These additional winning opportunities can be accomplished by providing the player with the additional wagering opportunities or by providing additional winning combinations of cards.

To provide new and previously unavailable winning hands requires a bit of imagination and must also fit certain characteristics in order to be economically feasible. In order for large payouts to be feasible for gaming establishments, it is desirable that the odds of achieving a "jackpot" hand are within a predetermined range. By meeting these requirements, the game will be economically feasible for the gaming establishment to offer, and will also provide the opportunity for large jackpot payouts and large winning opportunities.

Wagering games, and particularly card wagering games, typically exist in two formats: (1) table games, and (2) video games. Table games have existed for a long period of time wherein cards are dealt to the player by a single dealer and play commences from that point. Furthermore, the rules and practices for table games are well understood and easy to follow. As previously mentioned, this makes the wagering game more attractive and well accepted.

Video wagering games have also increased in popularity due to their ease of play. These games are set up to mimic a table game using adaptations of table game rules and cards. Video games are also attractive to both players and gaming establishments because they can be played without the need for a dealer. This provides the players with the opportunity to play the video game in a somewhat isolated environment. Furthermore, the use of a video format conveniently provides many additional dealing possibilities. For example, some methods of dealing cards can be easily carried out through a video configuration, wherein such dealing would be impractical at a table game. For example, it is difficult for the dealer to shuffle and keep separate multiple decks of cards.

In summary, it is always desired to find a game that is easy to play and also fast moving. When the player is provided with a considerable amount of participation and additional winning based on new card combinations, these games become much more attractive and enjoyable. Also, it is desirable to provide the players with numerous winning opportunities, especially large winning opportunities.

SUMMARY OF THE INVENTION

The method of the present invention provides a method of playing a new wagering game having unique winning hands and an enhanced payout schedule. Furthermore, the game method of the present invention provides the further possibility of very large winning amounts. Lastly, the method of the present invention provides for a wagering game with appropriate winning probabilities to make the game feasible for gaming establishments to provide the game to players.

To carry out the method of the present invention, a plurality of decks of standard playing cards are utilized. To initiate the game, the player makes a wager. This wager allows the player to participate in the game, and depending upon the amount of the wager, can dictate the potential payouts to the player. A predetermined number of cards are then dealt to the player such that each card is dealt to a predetermined card position from a predetermined deck of cards. For example, in the preferred embodiment a five card hand is created from cards dealt to each of five designated card positions, with each card position being dealt to from a separate deck of cards (i.e., a single deck of cards for each playing position).

The method of the present invention then progresses by allowing the player to play out their hand utilizing the dealt cards. During play, however, anytime a card is removed or discarded, the replacement card must come from the same deck of playing cards as that of the removed card. Again using one embodiment wherein the underlying base game is five card draw poker, the player can discard numerous cards and have them replaced by newer cards. Using the above mentioned dealing scheme, each discarded card must be replaced by a card from the same deck of cards. Stated alternatively, each deck of cards is assigned to a specific card position and the original card as well as any replacement card for that card position must come from the designated deck of playing cards assigned to that card position.

The use of multiple decks of playing cards to supply or feed each playing position creates a unique playing situation. Using the dealing method of the present invention, all of the standard well known poker hands are achievable by the player. Furthermore, additional new and unique card possibilities and winning outcomes are created. The basis for these new winning outcomes is the fact that the same card can appear more than once in a hand because multiple decks of playing cards are used. This leads to what are referred to as "suited" outcomes. Such outcomes occur when cards of the same rank, comprising a traditional winning outcome, are also all of the same suit. For example, a hand consisting of three fives, an eight and a ten, is a three of a kind hand; however, if all of the fives are of the same suit, this becomes a suited three of a kind. Similarly, any three fives and two eights is a full house, while three fives of diamonds and two eights of spades is a suited full house. Also, because any given card can appear more than once, five of a kind winning outcomes are possible. The highest ranking winning outcome is a suited five of a kind, which is a hand comprised of five identical cards; for example, five queens of hearts. In summary, a plurality of unique suited and unsuited winning combinations thus become a possibility using the dealing method of the present invention.

Using the method of the present invention, it is now possible to create new and unique payouts or payout schedules. These payout schedules may include payouts for all winning hands formerly used in standard poker type games, as well as the newly created hands. This situation creates additional winning possibilities for the player. Additionally, this game can be linked to a progressive type jackpot wherein a portion of each wager is contributed to the jackpot amount and this amount is won only by receiving the highest ranking hand. In the preferred embodiment of the present invention, the highest ranking hand would be a suited five of a kind which matches a preselected card rank and suit. Specifically, the highest jackpot is paid for five spade aces, with the next highest jackpot being paid for any other suited five of a kind. Of course, the highest jackpot could be assigned to any other specific card rather than the ace of spades.

The method of the present invention utilizes standard playing cards. It is possible to alter the method to utilize non-standard cards, such as jokers, as well as designating certain cards as wild cards.

It is possible to utilize this game in either a table format or a video format. However, due to the complexity of dealing, the game of the present method is particularly well suited to a video presentation.

BRIEF DESCRIPTION OF THE DRAWINGS

Further objects and advantages of the present invention can be seen by reading the following Detailed Description in conjunction with the drawings in which.

DETAILED DESCRIPTION OF THE INVENTION

Figure 1:
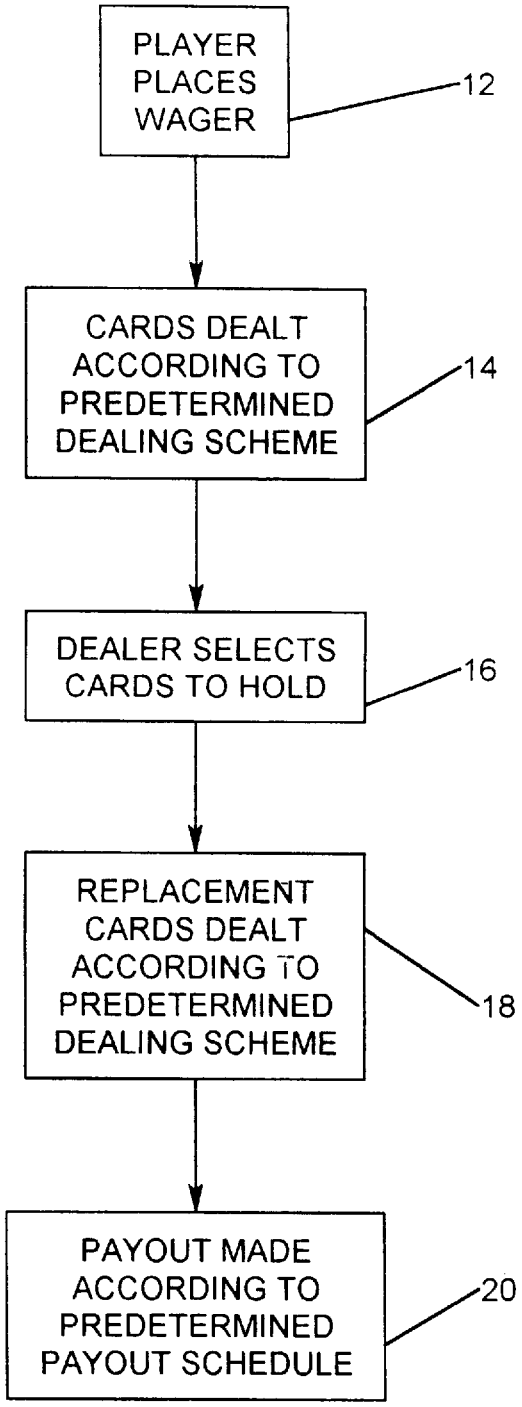
FIG. 1 is a flowchart describing the steps of the present card game.

Referring now to FIG. 1, there is shown a flowchart illustrating one embodiment of the present invention. It will be understood by those skilled in the art that certain alterations and modifications could be made to this particular embodiment while still utilizing the underlying concepts of the present invention. The method of the present invention involves a poker type card game utilizing many well known rules and practices involved in standard five card poker. This includes using the standard ranking of poker hands. However, due to the unique dealing scheme of the present invention, additional winning hands and additional winning opportunities are available to a player which have not been previously available.

Turning now specifically to FIG. 1, the method of the present invention is initiated by a player placing a wager to participate in the game (Wager Step 12). Cards are then dealt to the player according to a predetermined dealing scheme (Initial Dealing Step 14). This predetermined dealing scheme creates the opportunity for new winning hands to be created and consequently new winning opportunities for the players. Further explanation of the predetermined dealing scheme will be described in conjunction with FIG. 2 below.

Next, the player selects cards to hold and cards to discard (Select Holds Step 16). This process is very well known and understood to those familiar with five card draw poker. In the game of the present invention, there is no specific requirement to hold any number of cards as all five cards can be discarded. Following the player's hold selections, replacement cards are dealt to the player for each of their discarded cards (Deal Replacement Cards Step 18). Again, these replacement cards are dealt to the player according to the predetermined dealing scheme further described below. Following the dealer replacement cards, the hand is analyzed to assess or determine winning combinations of cards and the player is awarded winnings according to a predetermined payout schedule. This predetermined payout schedule includes awarded for the top well known poker hands as well as awards for a number of newly available winning hands.

Figure 2:
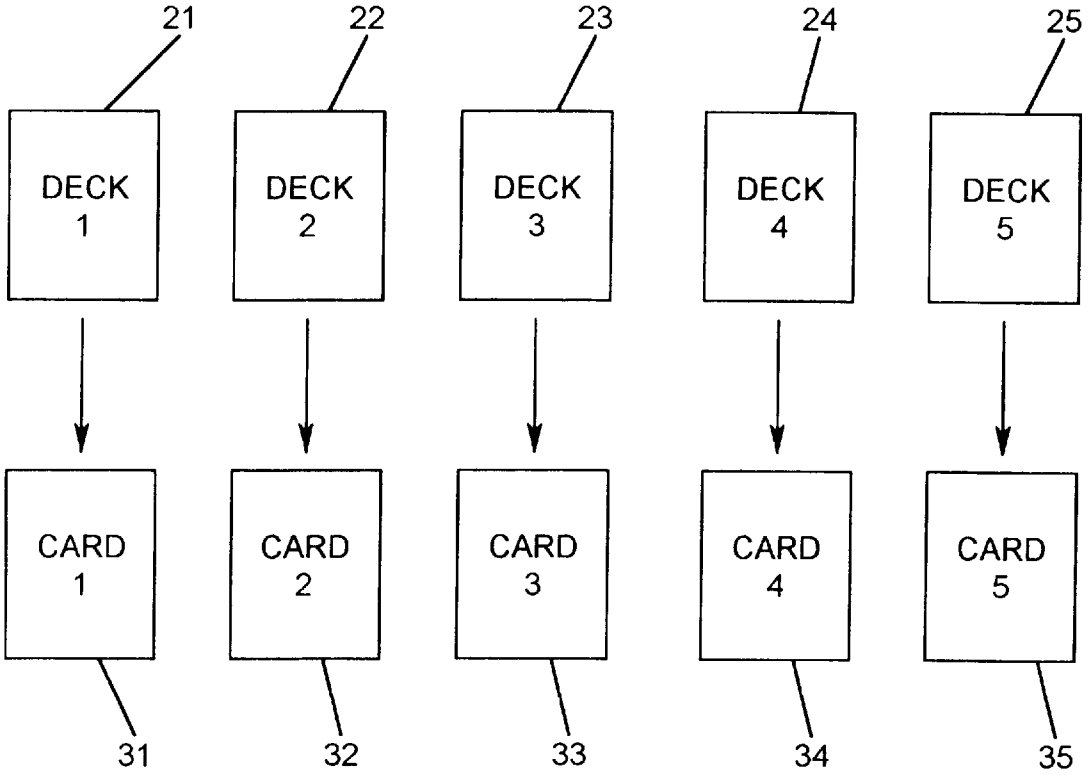
FIG. 2 illustrates one embodiment of a dealing scheme of the present invention.

Referring now to FIG. 2, the predetermined dealing scheme of the present invention is described in further detail. The method of the present invention utilizes a plurality of separate decks of playing cards to carry out the game. In the preferred embodiment, five separate standard 52 card decks of playing cards are utilized to deal to five separate card positions. Of course, decks containing jokers or other special decks could be used. Each of these decks are initially shuffled and then made available for dealing.

A separate deck of playing cards is used for each playing card position. A first deck of playing cards 21 is utilized for dealing to a first playing card position 31. Similarly, a second deck of playing cards 22 is utilized to deal to a second playing card position 32. The same is true for a third deck of playing cards 23 for dealing to a third card position 33, fourth deck of playing cards 24 for dealing to a fourth card position 34 and a fifth deck of cards 25 for dealing to a fifth card position 35. Therefore, when hands are dealt to the players, one card is dealt to each playing position from the appropriate deck of playing cards. Furthermore, when cards are discarded or replaced, replacement cards for each card position come from the corresponding deck of playing cards. As can easily be seen, this dealing scheme creates new and different card combinations which were not previously available. Furthermore, the odds of receiving particular hands and particular card combinations are greatly altered.

Card combinations in which cards match in both rank and suit are referred to as suited combinations. In a five of a kind suited hand, the player would receive five identical cards (five aces of spades for example). Furthermore, suited combinations could occur in numerous other hands. That is, a suited full house contains a suited three of a kind and a suited pair (for example, three queens of hearts and two aces of spades). This creation of new card combinations allows for additional "winning hands" to be made available. Consequently, the player has additional opportunities to win on these new "winning hands".

An alternative dealing method could involve the use of less than five decks of cards wherein each deck could supply some predetermined set of playing positions. For example, three decks of cards could be used: A first deck to supply the first two card positions, a second deck to supply the next two card positions, and a third deck to supply the last card position. Another alternative dealing method could include the use of multiple decks shuffled together.

Figure 3:
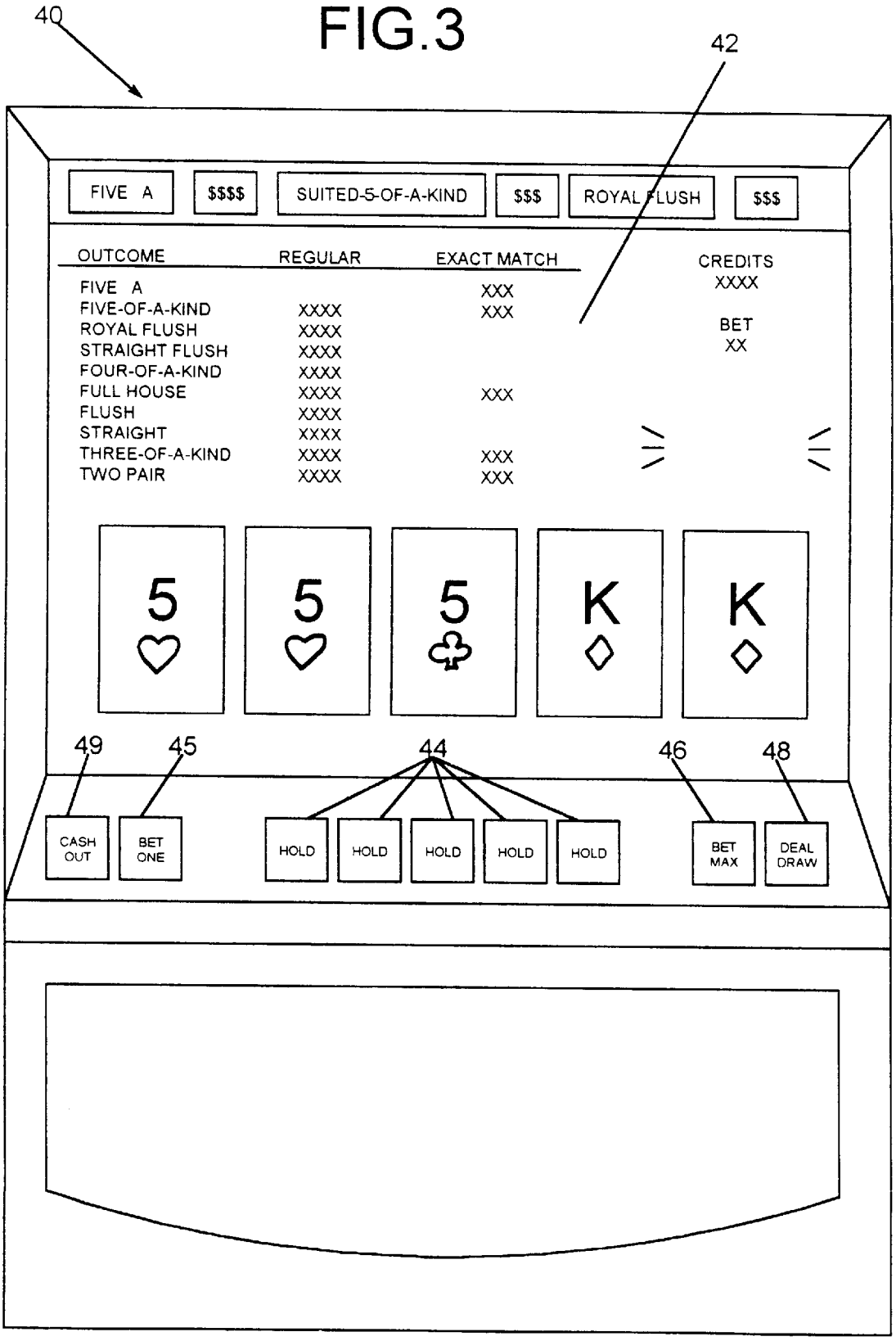
FIG. 3 shows an apparatus for carrying out the present game in a video display method.

The present method is equally applicable to both table games and video poker games. However, due to the complexity of the dealing scheme, the game of the present invention is particularly well suited to a video game implementation. Referring to FIG. 3, there is shown one example device for carrying out the game of the present invention. A video console 40 is shown having a display screen 42 and a plurality of control buttons 44, 45, 46 and 48. Video console 40 is recognized as a gaming machine or slot machine. Display screen 42 is a typical video display monitor which is used for displaying numerous information related to the game of the present invention. For example, the rank and suit of the dealt playing cards are indicated on this video display along with betting amounts, credits and potential winnings.

Figure 4:
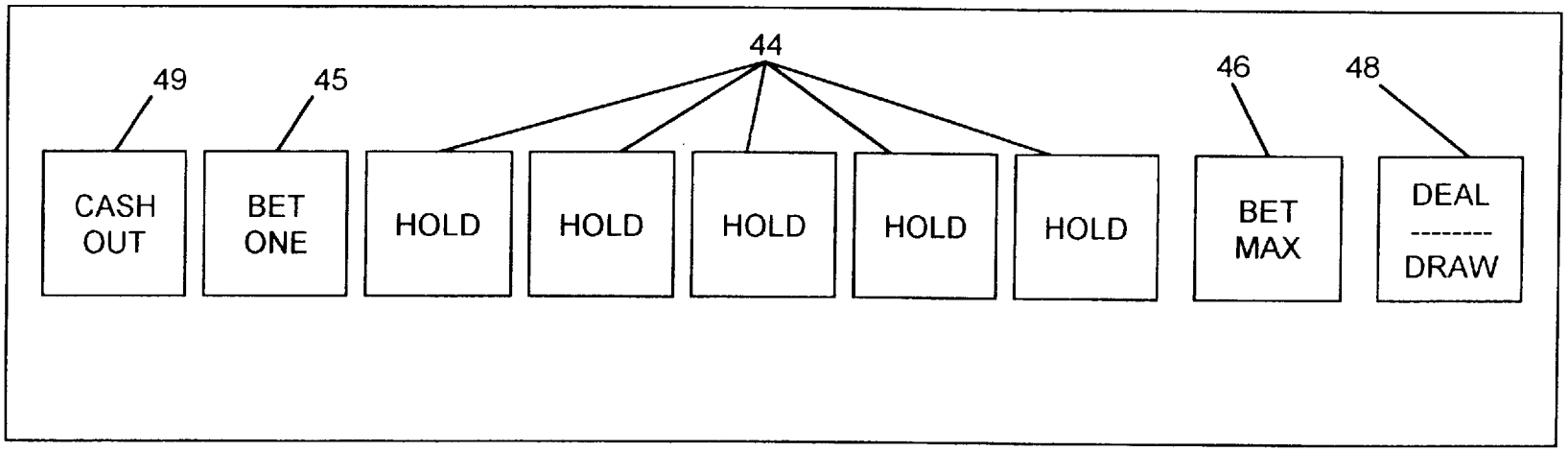
FIG. 4 is an expanded drawing of the buttons used on the apparatus of FIG. 3.

A plurality of card control buttons 44 are placed on the front of the video console and are used for selecting individual cards. As mentioned in reference to the flowchart of FIG. 1, there is a point in the present game wherein the player must select their hold cards. Card control buttons 44 are positioned below the display screen and correspond to each card position. At the appropriate time during the game, these control buttons can be depressed to select a particular card or cards. Bet buttons 45 and 46 are utilized to adjust the amount of money wagered during each particular hand. Bet one button 45 is utilized to wager a single unit (e.g. one dollar) while bet max button 46 is used to place the maximum wager for the particular machine. A deal/draw button 48 is utilized to initiate the dealing of cards, either during the initial deal of the hand or during the replacement deal portions of the game. Lastly, cash-out button 49 is used to end the game and pay money out to the player. Referring to FIG. 4, there is shown an exploded view of the control buttons of video console 40.

Figure 7:
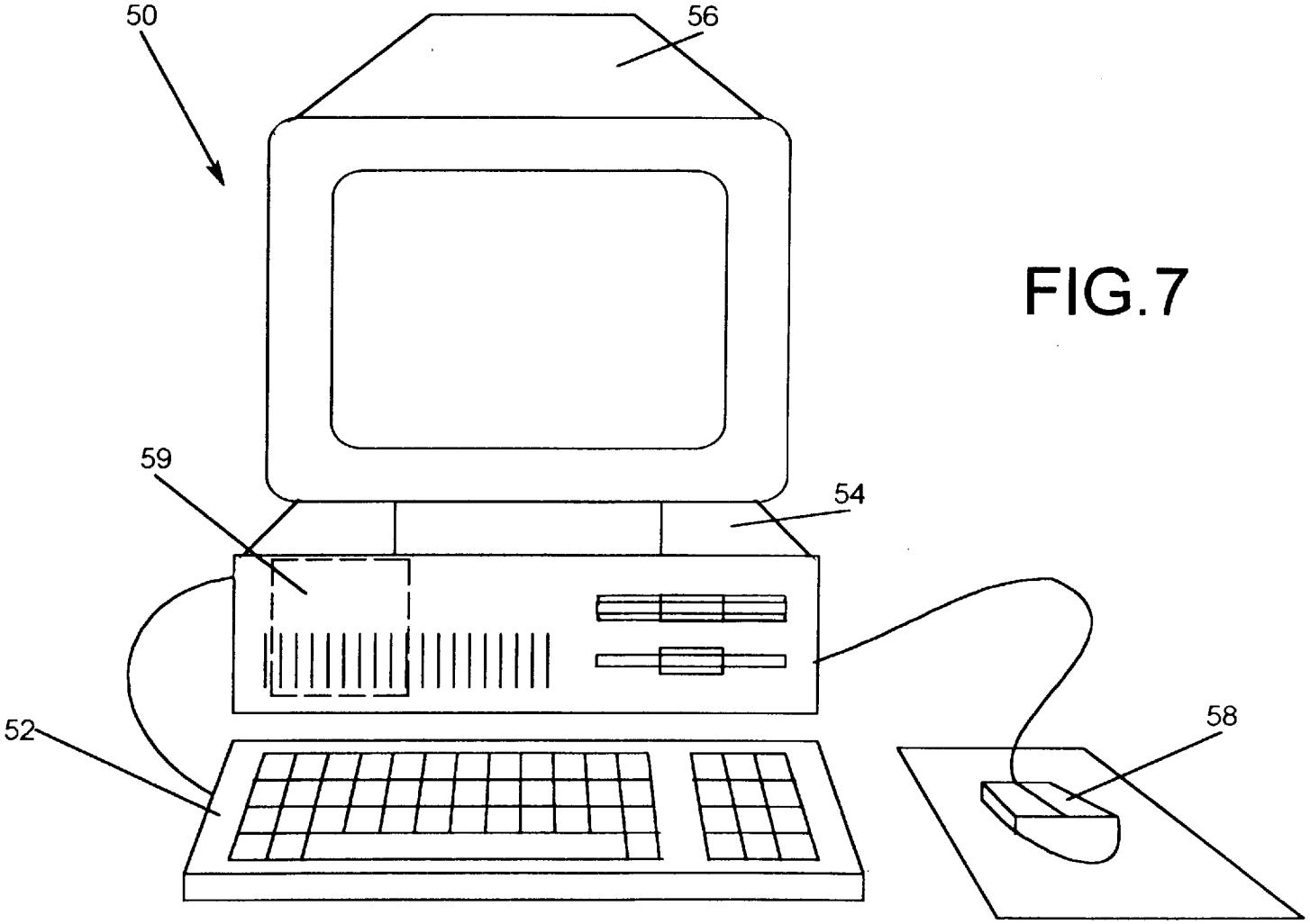
FIG. 7 shows a computer capable of carrying out the method of the present invention.

Referring now to FIG. 7, there is shown an alternative device for carrying out the game of the present invention. This device is more commonly recognized as a personal computer 50. Generally speaking, computer 50 has a keyboard 52, a processing unit 54, a monitor 56, and a pointing device 58. Also included within processing unit 54 is a storage unit 59. Pointing device 58 could include a track ball, or a standard computer mouse. It is well understood by those skilled in the art that numerous types of computers could be used to carry out the method of the present invention. The only requirement is that these computers have a display screen, some input mechanisms (e.g. keyboard 52 or pointing device 58) and processing capabilities.

Both computer 50 shown in FIG. 7 and video console 40 shown in FIG. 3 carry out the method of the present invention in much the same way. Each particular device is likely to have advantages in certain contexts; however, their function is essentially identical.

Figure 5:
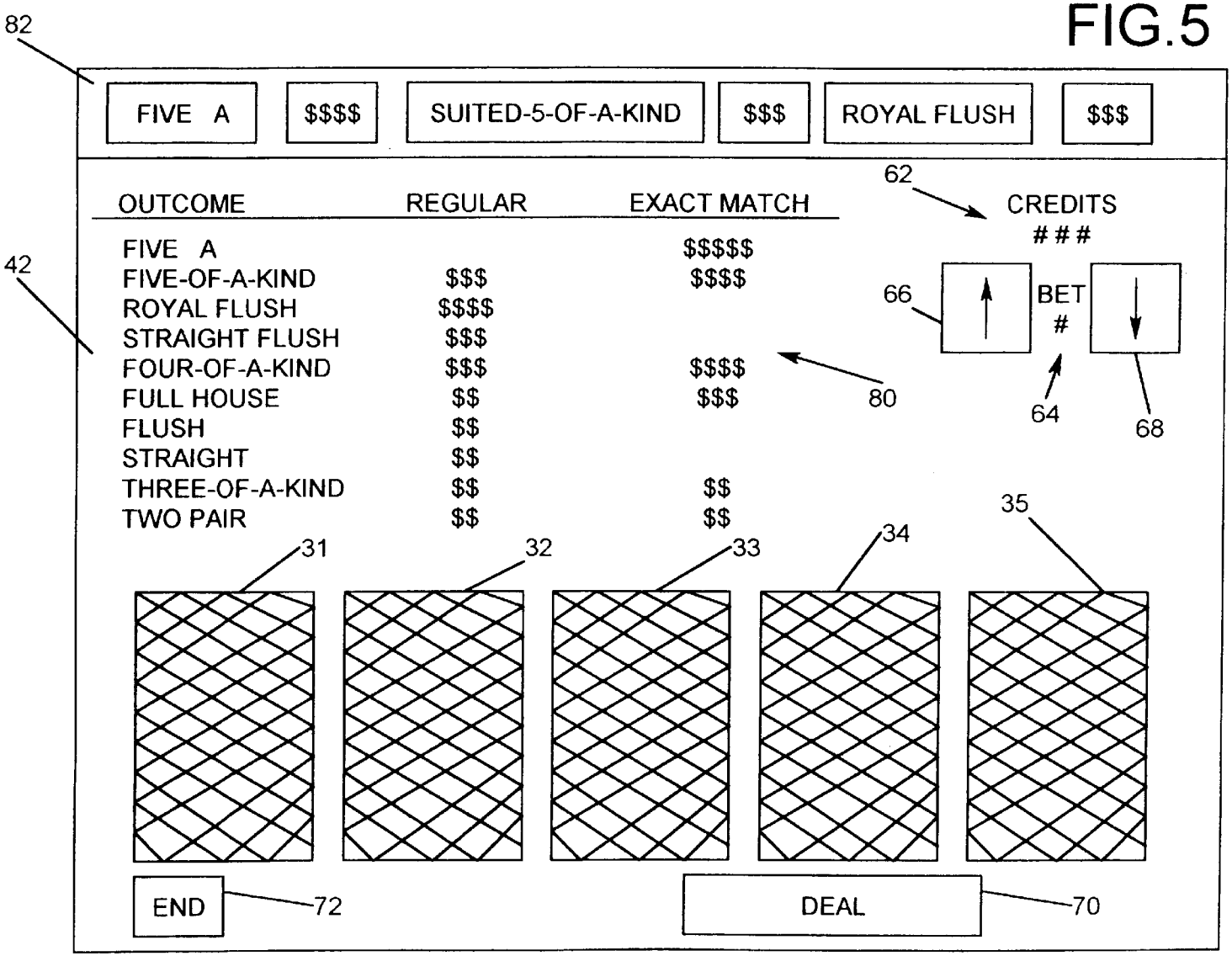
FIG. 5 illustrates the initial display screen presented to the player while playing the game of the present invention.
Figure 6:
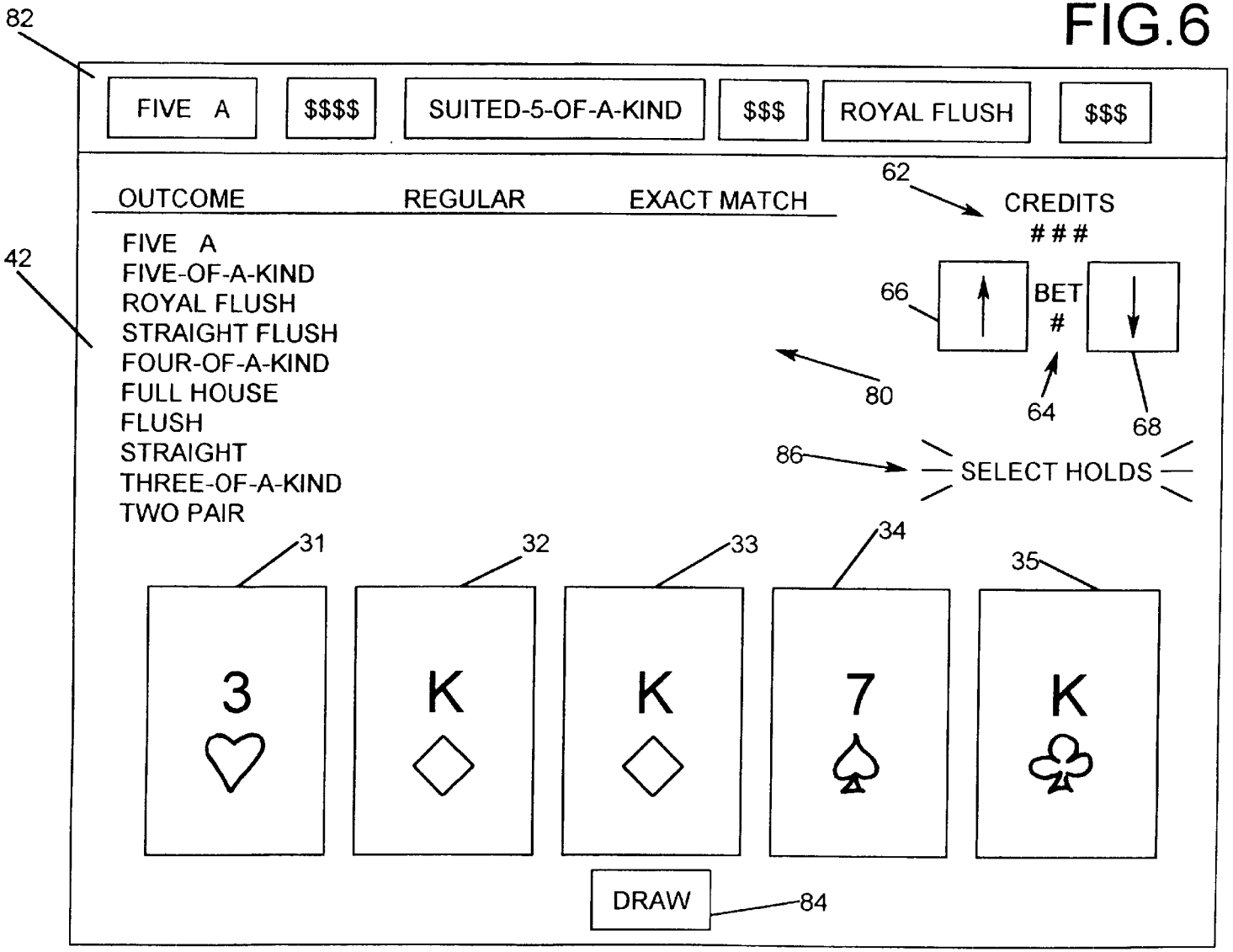
FIG. 6 illustrates an intermediate screen presented to the player while playing the game of the present invention.

Referring now to FIGS. 5 and 6 in which the display screens presented to a player are shown in more detail. The display screens of these figures represent the specific displays that would appear on computer 50. These particular displays are set up to accommodate the use of a pointing device as opposed to multiple selection buttons. However, it will be clearly understood that the function of the underlying method is identical. Specifically, in a video gaming machine, player control is generally accomplished by use of a multiplicity of selection buttons, as in FIG. 3, or, more recently, by use of a video touch screen.

Shown in FIG. 5 are a first card position 31, second card position 32, third card position 33, fourth card position 34 and fifth card position 35. Each of these card positions are represented as unidentified designs to represent the back side of a playing card. This representation would indicate to the player that no cards have been dealt at this point in time. In the upper right-hand corner of display 42 is a credit indicator 62. This credit indicator 62 will display the number of credits available for play. In a gaming machine, this credit indicator will be indicative of the money or tokens deposited for wagering. This amount is then available for separate wagers by the player.

Located directly below credit indicator 62 is a bet display 64. This display is utilized to indicate to the player the amount wagered for the particular hand being played. Immediately adjacent bet display 64 are bet toggle buttons 66 and 68. These buttons are utilized by the player to increase or decrease the amount of the wager. As is well known by those familiar with computers and pointing devices, by moving the pointing device so a pointer is placed directly over either bet increase toggle button 66 or bet decrease toggle button 68, and depressing or "clicking" a button on the pointing device, will cause the amount wagered to be increased or decreased accordingly. Alternately, in a gaming machine, betting is generally accomplished by using "bet one" and "bet max" buttons, where once a bet has been made, the option to decrease the amount wagered is not available. The present invention, of course, encompasses both of these betting schemes.

Located at the bottom of display screen 42 are a plurality of function buttons including a deal button 70 and an end button 72. In a gaming machine, the end button would be replaced by a "cash out" button. Again, each of these buttons can be invoked using the pointing device with the aid of the computer 50. Each of these buttons is utilized to invoke the corresponding command in the method of the present invention. For example, to initiate a new hand and deal the cards, deal button 70 is selected. To end the game or method of the present invention, the end button 72 is selected.

Also shown on display screen 42 is a payout table 80. This will display to the player all of the "winning hands" for which payouts will be made. This table is presented to the player to indicate the winning amounts available to the player. This payout table is reproduced below in Table I which lists one possible payout schedule. It will be clearly understood that the hands selected for payouts could be changed or altered to meet the particular needs of the gaming establishment or game provider.

TABLE 1

| Outcome | Regular | Suited |
|---|---|---|
| Five ♠ A's | | 20,000 X |
| Five-Of-A-Kind | 60 X | 1,000 X |
| Royal Flush | 250 X | |
| Straight Flush | 50 X | |
| Four-Of-A-Kind | 10 X | 20 X |
| Full House | 6 X | 12 X |
| Flush | 4 X | |
| Straight | 3 X | |
| Three-Of-A-Kind | 2 X | 4 X |
| Two Pair | 1 X | 2 X |

Wherein X is the amount of the player's wager. It is clearly understood that the winning amounts could easily be changed. Also, it is recognized that the "jackpot hand" (listed as Five ♠ A's above) could easily be changed. This could be a randomly selected card, a permanently designated card, or a card chosen by the player.

The method of the present invention also provides the player with the opportunity to participate in a progressive winnings game. In this configuration, when the players place the maximum wager, they are eligible to win the progressive jackpots. The amounts of the payouts for top hands (e.g. suited-five-of-a-kind, royal flush) will then increase further. In the preferred embodiment of the present invention, a portion of all wagers is contributed to a progressive jackpot notwithstanding the fact that a player must place a maximum wager to be eligible to win any progressive jackpot. Of course, alternate methods of funding the progressive jackpot might be utilized such as only contributing a portion of all maximum wagers to the jackpot prize pool. When progressive jackpots are available, one possible payout table could be:

| Outcome | Regular | Suited |
|---|---|---|
| Five ♠ A's | | 1st Progressive |
| Five-Of-A-Kind | 60 X | 2d Progressive |
| Royal Flush | 3d Progressive | |
| Straight Flush | 50 X | |
| Four-Of-A-Kind | 10 X | 20 X |
| Full House | 6 X | 12 X |
| Flush | 4 X | |
| Straight | 3 X | |
| Three-Of-A-Kind | 2 X | 4 X |
| Two Pair | 1 X | 2 X |

In the upper portion or upper banner 82 of display screen 42 there is listed the progressive meters for the eligible progressive hands. In this embodiment, three winning hands are listed as progressive winners: (1) five spade aces, (2) a suited five-of-a-kind other than five spade aces, and (3) a royal flush. Of course, more or fewer hands could be eligible for progressive jackpots. Typically, when a progressive jackpot is utilized, numerous machines (either computers 50 or video consoles 40) are linked to one another and are coordinated to keep track of progressive amounts for each of these hands. This progressive jackpot capability provides the player the opportunity of winning large amounts for these selected unusual hands.

As previously mentioned to initiate the game, the player will select deal button 70. Following selection of this button, cards are dealt to the player in each of the five card positions (first card position 31, second card position 32, third card position 33, fourth card position 34, and fifth card position 35). A representation of the display then presented to the player is shown in FIG. 6. As can be seen, cards' faces are now shown in each of the five card positions 31 through 35, and the control buttons at the bottom of the display have changed slightly. Now shown at the bottom of the display is a draw button 84. Also shown is a "select holds" display 86. The select holds display 86 is an indicator to the players that they must select cards which they wish to hold or keep at this point in time. Any cards not held will be replaced with additional cards when the draw button 84 is selected. To select cards to be held, the player may simply place the pointer over the desired card and "click" on the pointing device. Alternately, where a multiplicity of buttons are used for player selections, the player would press buttons corresponding to the cards which are to be held. This will cause an indicator to be displayed on the cards stating that that card will be held. Following the player's selection of cards, draw button 84 is selected whereby the unselected cards will be replaced with new cards.

Following the replacement of cards, the player's hand will be examined to determine if it contains a winning combination of cards. (Again, all winning combinations are displayed on display screen 42.) If such a winning combination exists, a winning indicator will be displayed on the screen indicating the number of coins or credits won and these credits will then be added to credit indicator 62. At this point, a new display is presented to the player which is identical to that of FIG. 5 with one exception. The display now presented to the player has the existing cards from the last draw still displayed on the screen rather than a depiction of the back of the playing card. Aside from this difference, all of the same indicators and buttons are presented to the player thus allowing the player to immediately initiate another hand.

As previously mentioned, the game of the present invention is particularly well suited to video or computer presentation. However, it is clearly understood that table games and many other type of video games could be played utilizing the method of the present invention.

The above description has referred to a standard five card draw poker game. It should be recognized that the underlying game can be altered without departing from the scope of the present invention. For example, it is clearly understood that any of the following games could be played as the underlying game: Five card stud poker, seven card draw poker, seven card stud poker, etc. Furthermore, any variation of a card game having an established ranking of cards could easily be adapted utilizing the principles of the present invention.

It would be understood that the above described method could be altered in numerous ways without departing from the principles of the present invention. We claim all modifications coming within the scope and spirit of the following claims.

It is claimed:

1. A method of playing a poker type card game comprising the steps of:

a. a player initiating the game;

b. providing a plurality of decks of playing cards, each deck sharing a multiplicity of identical cards;

c. keeping each deck separate from each other wherein the decks are never shuffled or mixed together;

d. dealing an initial poker hand to the player in a preselected pattern, wherein the player's initial poker hand has at least one card from each deck; and e. the player receiving a predetermined amount based on the poker hand that the player holds.

2. The method of claim 1 wherein the game is initiated by the player placing a wager.

3. The method of claim 1 wherein the poker type card game is five card draw poker.

4. The method of claim 1 wherein the poker type card game is five card stud poker.

5. The method of claim 1 wherein the poker hand is made up of a plurality of cards in a plurality of playing positions and preselected pattern involves the dealing of cards from a preselected one of the plurality of decks to each playing position.

6. The method of claim 1 wherein the plurality of decks of playing cards includes five decks and wherein the poker type card game is a five card poker game.

7. The method of claim 6 wherein the five card type poker game is five card draw poker.

8. The method of claim 1 wherein the predetermined amount and the corresponding type of poker hand are as follows:

| Outcome | Regular | Suited |
|---|---|---|
| Five ♠ A's | | 20,000 X |
| Five-Of-A-Kind | 60 X | 1,000 X |
| Royal Flush | 250 X | |
| Straight Flush | 50 X | |
| Four-Of-A-Kind | 10 X | 20 X |
| Full House | 6 X | 12 X |
| Flush | 4 X | |
| Straight | 3 X | |
| Three-Of-A-Kind | 2 X | 4 X |
| Two Pair | 1 X | 2 X |

Wherein X is the amount of the player's wager.

9. The method of claim 1 wherein at least one deck includes at least one joker.

10. The method of claim 1 wherein the deck is a special deck.

11. A method of playing a game of poker comprising the steps of:

a. a player initiating the game;

b. providing a first, a second, a third, a fourth and a fifth deck of playing cards. wherein each deck shares a multiplicity of identical cards;

c. keeping each deck separate from each other, wherein the decks are never shuffled together;

d. dealing an initial five card poker hand to the player by dealing one card from each of the first deck, the second deck, the third deck, the fourth deck, and the fifth deck of playing cards to said player;

e. said player discarding up to a predetermined number of said first cards;

f. dealing replacement cards to the player wherein each replacement card is dealt from the same deck of cards as was the card that is being replaced;

g. said player receiving a predetermined amount based on the type of poker hand that said player holds.

12. The method of claim 11, wherein the game is initiated by said player placing a first wager.

13. The method of claim 11, wherein the predetermined amount that a player receives is according to the following schedule:

| Outcome | Regular | Suited |
|---|---|---|
| Five ♠ A's | | 20,000 X |
| Five-Of-A-Kind | 60 X | 1,000 X |
| Royal Flush | 250 X | |
| Straight Flush | 50 X | |
| Four-Of-A-Kind | 10 X | 20 X |
| Full House | 6 X | 12 X |
| Flush | 4 X | |
| Straight | 3 X | |
| Three-Of-A-Kind | 2 X | 4 X |
| Two Pair | 1 X | 2 X |

14. The method of claim 11, wherein said first wager can be a specified maximum amount, and wherein the predetermined amount that a player receives when said first wager is said specified maximum amount, is according to the following schedule:

| Outcome | Regular | Suited |
|---|---|---|
| Five ♠ A's | | 1st Progressive |
| Five-Of-A-Kind | 60 X | 2d Progressive |

-continued

| Outcome | Regular | Suited |
|---|---|---|
| Royal Flush | 3d Progressive | |
| Straight Flush | 50 X | |
| Four-Of-A-Kind | 10 X | 20 X |
| Full House | 6 X | 12 X |
| Flush | 4 X | |
| Straight | 3 X | |
| Three-Of-A-Kind | 2 X | 4 X |
| Two Pair | 1 X | 2 X |

Wherein X is the amount of the player's wager and wherein 1st progressive, 2d progressive and 3d progressive are portions of a progressive jackpot.

15. A method of playing a wagering game which utilizes standard playing cards, comprising the steps of:

a. a player placing a wager to participate in the game;

b. providing a plurality of decks of playing cards, each deck sharing a multiplicity of identical cards;

c. keeping each deck separate from each other wherein the decks are never shuffled or mixed together;

d. dealing an initial hand which consists of a plurality of cards dealt to a plurality of playing positions by dealing at least one card from each deck to each playing position such that the player's initial hand has at least one card from each deck; and e. the player receiving a predetermined amount based upon the poker hand the player holds.

16. The method of claim 15 wherein the hand consists of five cards dealt to five playing positions, and the plurality of decks of playing cards consists of five separate decks of playing cards.

17. The method of claim 16 wherein each playing position is dealt to exclusively from one of the five separate decks of playing cards.

18. The method of claim 15 wherein the predetermined arrangement of cards includes a plurality of well known poker hands.

19. The method of claim 15 wherein prior to the step of awarding the predetermined amount, the method further comprises the steps of:

a. the player selecting cards in the hand to keep and cards to discard, and b. dealing replacement cards to replace the discarded cards, wherein the replacement cards are dealt from the preselected deck of cards.

20. A method of playing a poker type card game comprising the steps of:

a. a player initiating the game;

b. providing a plurality of decks of playing cards, each deck sharing a multiplicity of identical cards;

c. keeping each deck separate from each other wherein the decks are never shuffled or mixed together;

d. dealing an initial poker hand to the player in a preselected manner from the plurality of decks of cards wherein the initial poker hand includes at least one card from each deck; and e. the player receiving a predetermined amount based upon the poker hand the player holds, wherein the player receives the predetermined amount when the hand includes a new winning hand.

21. The method of claim 20 wherein the new winning hands includes a plurality of suited outcomes.

22. The method of claim 21 wherein the new winning hands include a matched, suited five of a kind, a suited five of a kind, a five of a kind, a suited four of a kind, a suited three of a kind, a suited full house, suited two pairs.

23. The method of claim 20 wherein the preselected manner of dealing includes utilizing five decks of cards which are shuffled together prior to the step of dealing.

24. The method of claim 23 wherein the five decks of playing cards are dealt from a shoe.

25. The method of claim 23 wherein the poker type game is five card draw poker.

26. The method of claim 23 wherein the predetermined amount is a progressive jackpot.

27. A video gaming apparatus for allowing a player to play a wagering game, comprising:

a display for presenting video representations of cards to the player;

a user interface for allowing the player to make choices during the play of the wagering game; and a processor attached to the display and the user interface, the processor for carrying out the steps of the wagering game, wherein these steps include:

a. the player initiating the game utilizing the user interface;

b. presenting the video representations of cards in a manner to replicate the dealing of an initial poker hand to the player in a preselected manner from a plurality of decks of cards wherein each deck shares a multiplicity of identical cards; but each deck being kept separate from each other such that the decks are never shuffled or mixed together; and wherein the initial poker hand includes at least one card from each deck; and c. the player receiving a predetermined amount based upon the poker hand the player holds, wherein the player receives the predetermined amount when the hand includes a new winning hand.

28. The apparatus of claim 27 wherein the new winning hands includes a plurality of suited outcomes.

29. The apparatus of claim 28 wherein the new winning hands include a matched, suited five of a kind, a suited five of a kind, a five of a kind, a suited four of a kind, a suited three of a kind, a suited full house, suited two pairs.

30. The apparatus of claim 28 wherein the five decks of playing cards are dealt as if they are coming from a shoe.

31. The apparatus of claim 28 wherein the poker type game is five card draw poker.

32. The apparatus of claim 28 wherein the predetermined amount is a progressive jackpot.

33. The method of claim 28, wherein the predetermined amount that a player receives is according to the following schedule:

| Outcome | Regular | Suited |
|---|---|---|
| Five ♠ A's | | 20,000 X |
| Five-Of-A-Kind | 60 X | 1,000 X |
| Royal Flush | 250 X | |
| Straight Flush | 50 X | |
| Four-Of-A-Kind | 10 X | 20 X |
| Full House | 6 X | 12 X |
| Flush | 4 X | |
| Straight | 3 X | |
| Three-Of-A-Kind | 2 X | 4 X |
| Two Pair | 1 X | 2 X |

34. The method of claim 28, wherein said first wager can be a specified maximum amount, and wherein the predetermined amount that a player receives when said first wager is said specified maximum amount, is according to the following schedule:

| Outcome | Regular | Suited |
|---|---|---|
| Five ♠ A's | | 1st Progressive |
| Five-Of-A-Kind | 60 X | 2d Progressive |
| Royal Flush | 3d Progressive | |
| Straight Flush | 50 X | |
| Four-Of-A-Kind | 10 X | 20 X |
| Full House | 6 X | 12 X |
| Flush | 4 X | |
| Straight | 3 X | |
| Three-Of-A-Kind | 2 X | 4 X |
| Two Pair | 1 X | 2 X |

Wherein X is the amount of the player's wager and wherein 1st progressive, 2d progressive and 3d progressive are portions of a progressive jackpot.

35. The apparatus of claim 27 wherein the preselected manner of dealing includes utilizing five decks of cards which are shuffled together prior to the step of dealing.

36. The apparatus of claim 27 wherein the user interface includes a plurality of buttons.

37. The apparatus of claim 27 wherein the user interface includes a computer pointing device.

* * * * *